US008039824B2

(12) United States Patent
Grinder et al.

(10) Patent No.: US 8,039,824 B2
(45) Date of Patent: Oct. 18, 2011

(54) CANISTER FOR FINAL REPOSITORY OF SPENT NUCLEAR FUEL

(76) Inventors: Olle Grinder, Vällingby (SE); Gunnar Hultqvist, Stallarholmen (SE); Peter Szakalos, Stockholm (SE)

( * ) Notice: Subject to any disclaimer, the term of this patent is extended or adjusted under 35 U.S.C. 154(b) by 133 days.

(21) Appl. No.: 12/598,941

(22) PCT Filed: May 26, 2008

(86) PCT No.: PCT/SE2008/050615

§ 371 (c)(1),
(2), (4) Date: Nov. 10, 2009

(87) PCT Pub. No.: WO2008/153478

PCT Pub. Date: Dec. 18, 2008

(65) Prior Publication Data

US 2010/0090134 A1 Apr. 15, 2010

(30) Foreign Application Priority Data

May 25, 2007 (SE) ..... 0701280

(51) Int. Cl.

| | |
|---|---|
| ***G21F 1/12*** | (2006.01) |
| ***G21F 5/008*** | (2006.01) |
| ***G21F 9/16*** | (2006.01) |
| ***G21F 9/34*** | (2006.01) |

(52) U.S. Cl. ..... 250/506.1; 250/507.1; 376/272; 588/16; 588/15

(58) Field of Classification Search ..... 250/506.1, 250/507.1; 588/16, 15; 376/272
See application file for complete search history.

(56) References Cited

U.S. PATENT DOCUMENTS

| | | | | |
|---|---|---|---|---|
| 4,562,001 | A * | 12/1985 | Vietzke et al. | 588/16 |
| 4,800,062 | A * | 1/1989 | Craig et al. | 376/272 |
| 4,834,917 | A * | 5/1989 | Ramm et al. | 588/15 |

FOREIGN PATENT DOCUMENTS

| | | | |
|---|---|---|---|
| JP | 2004251724 | A | 9/2004 |
| SE | 509177 | C2 | 6/1996 |

OTHER PUBLICATIONS

International Search Report and Written Opinion issued in parent PCT application, Dated: Aug. 21, 2008.

Frankel, G.S., Corrosion Reliability Prediction: Long Term Nuclear Waste Storage in Yucca Mountain, Office of Scientific and Technical Information, Oak Ridge, Aug. 18, 2005, OSTI ID: 859261, MOL 20051017, 0209 DC #45393,http://www.osti.gov/bridge/product.biblio.jsp?osti_id=859261, abstract.

King, F. et al., Copper Corrosion Under Expected Conditions in a Deep Geological Repository, SKB Report, TR-01-23, SKB, Stockholm, Sweden 2001, p. 1-176; p. 134-136.

* cited by examiner

*Primary Examiner* — Nikita Wells

(74) *Attorney, Agent, or Firm* — Jeffrey S. Melcher; Manelli Selter PLLC

(57) ABSTRACT

The invention relates to a canister (1) for final repository of spent fuel elements from a nuclear reactor, comprising an insert (2) that contains said spent fuel elements, an inner copper casing (4*a*, 4*b*, 4*c*) that encloses the insert (2), and at least one outer casing (5*a*, 5*b*, 5*c*) that encloses the copper casting and that consists of a passive-film-forming metal or metal alloy, the passive film on the casing being constituted by an essentially oxidic film that is rich in one or more of the metals in the group of metals that consist of the metals zirconium, chromium and titanium.

22 Claims, 2 Drawing Sheets

CANISTER FOR FINAL REPOSITORY OF SPENT NUCLEAR FUEL

Figure 1:
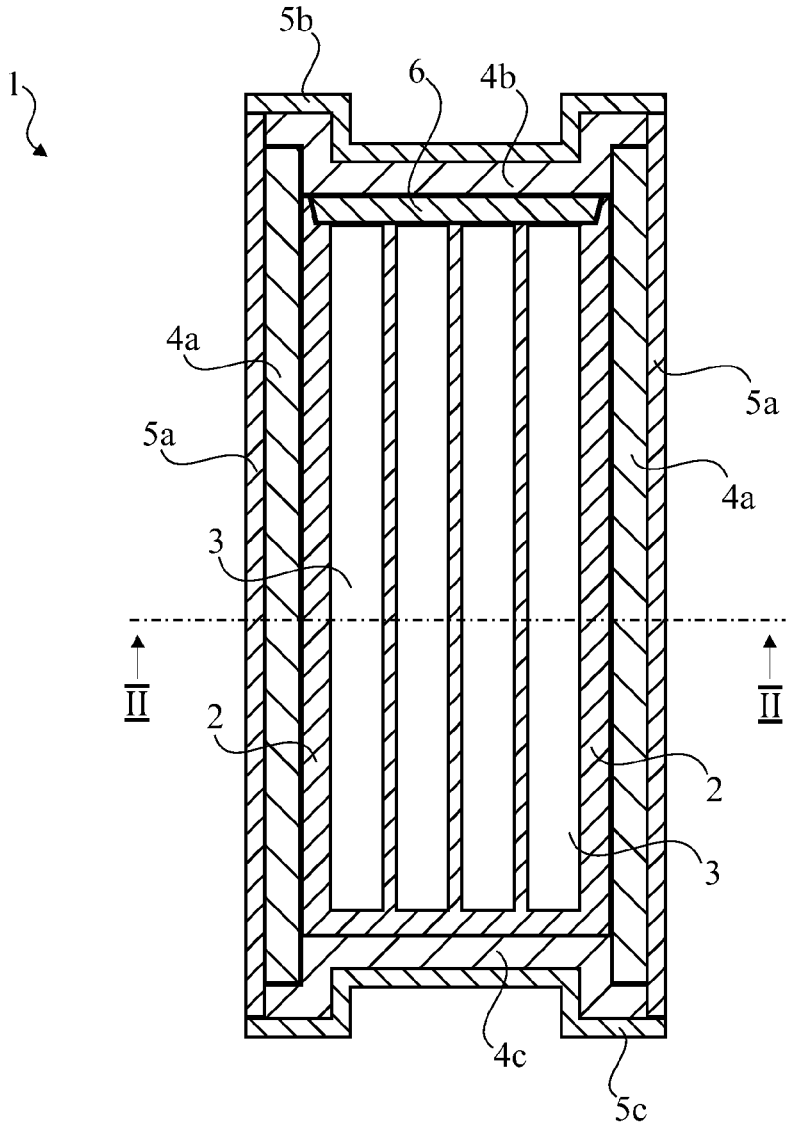

This application is a national stage entry under 35 U.S.C. 371 of International Application No. PCT/SE2008/050615, filed 26 May 2008, designating the United States. This application claims foreign priority under 35 U.S.C. 119 and 365 to Swedish Patent Application No. 0701280-0, filed 25 May 2007.

TECHNICAL FIELD

The present invention relates to a canister for final repository of radioactive waste, particularly for spent nuclear fuel in the form of fuel elements. More specifically, the invention relates to canisters with spent nuclear fuel, which are intended to be deposited in deep subterranean repository for at least a hundred thousand years.

BACKGROUND

No prior art exists today for rendering spent nuclear fuel harmless in large scale. Hence, various concepts have been developed in order to bury the spent nuclear fuel in primary rock. The spent nuclear fuel may have to rest in the primary rock for hundreds of thousands of years before the radioactivity has abated to a level that is harmless to man and animal. It is important during this long period of time to ensure that the fuel does not dissolve such that radioactive particles rise to ground surface via the ground water.

Water is needed in order for the spent fuel to dissolve and spread. It is hence important for the final repository to ensure that the spent fuel is maintained encapsulated in a tight canister and thereby is prevented from contacting the surrounding water until the radioactivity has abated to a low level. In most of the hitherto developed concepts the final repository comprises a system of barriers (canister, buffer and rock) that together are intended to prevent the radioactive species of the fuel from reaching ground surface. If one barrier does not work as planned, the other barriers will nevertheless guarantee safety, according to SKB, the Swedish Nuclear Fuel and Waste Management Co (www.skb.se). The canister (with an insert) is closest to the fuel. It is this barrier that is primarily intended to isolate the fuel from the surroundings. The objective of the canister in the repository is to completely encapsulate the spent fuel for a very long time, since no radioactive species can reach ground surface as long as the canister is tight.

The Swedish Nuclear Fuel and Waste Management Co has developed a concept, the KBS-3 method, that is based on encapsulation of spent nuclear fuel in a protective copper casing that is thereafter embedded in bentonite clay at a depth of 500 meters in the primary rock. Hereby, the bentonite clay acts as a buffer against mechanical stress in the canister caused by rock movements and will also limit the ground water flow. Inside the protective copper casing there is a nodular iron insert in order to increase strength.

The copper casing is joined together by e.g. friction welding or electron beam welding or some other welding method. Countries such as Sweden, Finland and Canada are planning to deposit their spent nuclear fuel according to this concept or a similar one.

Copper is classified as a corrosion allowing metal in water that contains $O_2$. SKB is of the opinion that the rate of corrosion in anoxic (free from gaseous oxygen) ground water only depends on accessible sulphur and that it hence is extremely low. It is thereby considered that the copper will give a perfect protection against corrosion until the radioactivity has abated. On page 28, second paragraph of the SKB report *Encapsulation—When, where, how and why*? (SKB Art. 141 2008) the following statement can be read: Today we really know all we need to know about corrosion in order to design the canister and the respitory to be safe for much more than 100,000 years. The present consensus about copper corrosion is also summarised in *SKB Technical report Tr*-01-23.

Other countries have chosen another concept according to which a corrosion resistant metal such as titanium, titanium alloys, high-alloy stainless steel or nickel alloys has been chosen for the casing, instead of a corrosion allowing metal. It is characteristic for such alloys that their excellent resistance to corrosion is achieved by the formation of a thin passive layer of oxide (so called passive film) that forms on the outer surface of the metal.

Irrespective of the choice of material for the canister casing, the demands are very high since they will be exposed to hard environments for a long time, such as:

- ground water that contains sulphide and chloride.
- ground water that contains $O_2$ (oxidising) for 1-3,000 years.
- Anoxic environment for the following 100,000-1,000,000 years.
- Elevated temperatures (30-100° C.) for 10,000 years due to radioactive decay of the fuel.

For the alloys that form passive films there is a certain risk of pitting corrosion, particularly if the chloride content of the ground water gets very high. This is a problem for the concepts based on the corrosion resistance of a passive layer. Accordingly, there is a risk that the barrier that is to be constituted by the canister is prematurely penetrated.

The applicant has surprisingly found that copper is not immune in water free from $O_2$ (anoxic water). This means that the rate of corrosion of copper in contact with anoxic ground water is much higher than previously assumed. Moreover, it has surprisingly been found that the rate of corrosion of copper in an anoxic water environment is very temperature sensitive and completely unacceptable rates of corrosion are achieved at 60-90° C. with the formation of a high hydrogen-containing, porous and non-protective oxide. Such temperatures may exist for up to 10,000 years due to the activity of the fuel.

This means that none of the above mentioned concepts will result in a corrosion protection that, with adequate safety margins, will cope with the conditions that the canisters may be exposed to, until the radioactivity has abated to levels that are harmless to man and animal.

It should also be noted that the canisters in question for spent nuclear fuel are relatively large. The canisters according to the KBS-3 method are almost five meters high and have a diameter of slightly more than one meter. The casing consists of copper with a thickness of five centimeters. In order to enhance strength, it has an insert of nodular iron which is a type of cast iron, on the inside. When the canister is full of spent fuel it will weigh between 25 and 27 metric ton.

SE 425,707 and U.S. Pat. No. 4,834,917 are both based on hot isostatic pressing (HIP) of copper powder for the manufacturing of the outer canister. However, hot isostatic pressing of copper powder for this purpose has several drawbacks:

1) A HIP:ed copper powder may result in worse corrosion and mechanical properties than the KBS-3 method with hot formed (forged) OFP copper alloy as suggested by the SKB.
2) It is expensive and technically difficult to HIP such large canisters as are required by the KBS-3 concept (diameter of about 1 m, height of about 5 m).

3) All methods that require for the radioactive material to be positioned inside the inner canister during the sintering process/HIP are completely out of the question in order to achieve an improvement over the KBS-3 concept, since the fuel rods do not withstand high temperatures. That is because it is very hard to avoid oxidation of the main component of the spent nuclear fuel pellets, $UO_2$, to higher oxides at elevated temperatures. Such a conversion is risky since it may result in a 35% volume expansion and pulverization of the pellets. In addition, the solubility of the higher oxides is too high in this context.
4) It is estimated that a certain percentage of the fuel rods (zircaloy tubes with uranium dioxide pellets) will contain water absorbed/adsorbed in the porous $UO_2$ pellets during the interim storage that takes place in a water reservoir for 30-40 years (alternatively from the time period in the reactor). It is not considered to be technically/economically possible to dry the fuel rods after the interim storage, to a guaranteed dryness. This means that if the $UO_2$ pellets are exposed to heat treatment they will rapidly react with moisture and water during heating, which must not take place (see paragraph 3).

SE 509,177 shows an example on how to produce a canister for the KBS-3 method, i.e. a canister comprising an inner steel canister and an outer copper canister. The outer copper canister is formed by electrolytic copper coating of the inner steel canister.

U.S. Pat. No. 4,562,001 shows a container that comprises at least three layers of different metals, which, from the outside inwardly, are always more noble. In one example, the outer layer consists of cast iron, the intermediate layer consists of nickel or a nickel alloy, and the inner layer consists of copper or a copper alloy. The problem of having an outermost non-noble metal such as cast iron or carbon steel, is the strong development of gaseous hydrogen due to anoxic corrosion. In this corrosion reaction, the thermodynamic equilibrium pressure of hydrogen is about 700 bar (Thermo Calc software, SSUB-database 2006).

In all repository methods in which bentonite clay is to be used as external buffer around the metal canister (such as in KBS-3), there must not be any build-up of hydrogen gas pressure since that may ruin the buffer protection by the formation of holes and channels in the bentonite clay, which in turn results in far too fast transport paths for gas, water and ions in the same. The hydrogen released from anoxic corrosion of iron furthermore results not only in hydrogen gas ($H_2$) but also in a considerable amount of atomic hydrogen (H) that migrates into the metal. This electrochemical hydrogen load due to corrosion of iron is harmful also to nickel and copper alloys that are not per se classified as particularly hydrogen sensitive alloys. The problem is that hydrogen load due to corrosion of iron can be said to correspond to a hydrogen gas pressure in the magnitude of 700 bar. A strong hydrogen activity will degrade virtually all metals (including copper and nickel alloys) in terms of mechanical properties (strength, creep ductility, toughness, etc.), and in addition the corrosion resistance will decrease for copper and nickel alloys at the same time as the risk of stress corrosion cracking (SCC) and hydrogen embrittlement increases.

Contrary to U.S. Pat. No. 4,562,001, the applicant's patent is based on a copper canister with an outer metal alloy that forms a passive film based on chromium oxide, zirconium oxide or titanium oxide. Note that copper is less noble in the electromotive series than the oxide forming alloys containing Zr, Ti, Cr in their passive state (normal state).

OBJECT OF THE INVENTION

The object of the present invention is to provide a canister for spent nuclear fuel, which solves at least one of the above mentioned problems.

Yet an object is to provide a canister that offers excellent protection against corrosion for at least 100,000 years.

Another object of the present invention is that the concepts developed for final repository of the copper canister, according to the KBS-3 method, can be used completely or partly also for the novel canister. It would e.g. be preferable for the canister to provide a good protection against corrosion also when embedded in bentonite clay.

Yet a purpose of the present invention is to provide a canister that need not be sealed by HIP:ing.

ACCOUNT OF THE INVENTION

At least one of the above mentioned objects or problems is achieved or solved by a canister for used nuclear fuel according to the present invention, which comprises spent fuel elements enclosed in a copper casing in combination with at least one outer metal layer of a passive-film-forming metal or metal alloy. It is preferable, in order to achieve an excellent protection against corrosion, that the outer metal layer forms an essentially hydrogen free passive film in anoxic ground water and hence it is suggested that the outer metal layer comprises an alloy that forms a zirconium, titanium or chromium rich oxide also in anoxic water.

The passive-film-formers get completely passivated in anoxic water and can withstand elevated temperatures as well as the oxidising conditions that initially prevail. The rate of corrosion of copper is however unacceptably high at elevated temperatures, also in water that is completely free from gaseous oxygen (anoxic water). Hence, the object of the passive film layer is to protect the outside of the copper casing for at least the first 10,000 years during which an elevated temperature is assumed to prevail. When the temperature has decreased enough due to the abating radioactivity, copper will however give a good protection against corrosion also in environments with high levels of chlorides.

In best case, if the ground water environment does not change to promote pitting corrosion (e.g. in case of high levels of $Cl^-$) of the passive-film-forming alloys, the outer casing as such can form a complete protection against corrosion for 100,000 years or more, particularly if it is made of a zirconium or titanium alloy. Zirconium or titanium alloys form nearly hydrogen free passive films also in anoxic water, i.e. the oxygen is taken from the water molecule without allowing the hydrogen to penetrate into the oxide or metal. This is most valid for zirconium (*Corrosion Science*, Volume 31, 1990, P. 149-154, G. Hultquist, et al.). Accordingly, a harmful Zr hydride can scarcely form in anoxic water below 100° C.

The conditions of the surrounding environment may change during the geological eras and in time unfavourable conditions could possibly lead to the formation of a small hole in the outer casing with the passive-film-forming metal or metal alloy. Even if this happens it is a process that will take a very long time and the elevated temperature due to the activity in the radioactive waste will be considerably much lower than in the beginning since the activity abates in time. That is, if a hole forms in the outer casing due to pitting corrosion, the temperature will have decreased to such a level that the rate of corrosion of the copper is low at that time, which means that the copper casing will provide an excellent protection against corrosion at a later point of time when the temperature is lower.

For alloys that form a passive film of chromium oxide it is also the case that if very high levels of $Cl^-$ are accumulated in the deep subterranean repository and the outer casing is penetrated due to $Cl^-$ induced pitting corrosion, the corrosion of the inner copper casing will be dampened since the slowly corroding outer casing constitutes a weak source of hydrogen. If a high enough hydrogen pressure, i.e. more than $1\times10^{-3}$ bar is built up, the copper will namely be virtually immune against corrosion in anoxic water even if the temperature is high. (It is probable that the hydrogen pressure will exceed $10^{-3}$ bar due to local corrosion of chromium oxide-forming alloys in anoxic water. It can be mentioned that in the atmosphere there is only $5\times10^{-7}$ bar of gaseous hydrogen). It is furthermore assumed that also chloride induced copper corrosion is counteracted by an increased hydrogen pressure.

A titanium rich passive film can be achieved by forming the outer metal layer of titanium or an alloy thereof, and a zirconium rich passive film can be achieved by forming the outer metal layer of zirconium or an alloy thereof.

A chromium rich passive film can be achieved by forming the outer metal layer from a nickel-based alloy (a cobalt-based alloy is also conceivable) with at least 12% by weight of Cr, preferably at least 14% by weight of Cr, or a stainless steel with a chromium content of at least 18% by weight of Cr.

The stainless steel alloys should preferably be alloyed with molybdenum and/or tungsten in order to increase the repassivation of the passive film, where W+Mo>0.15% by weight. In the choice of an austenitic stainless steel it is furthermore preferred that the nickel content is at least 12% Ni by weight. For the duplex stainless steel it is preferred that the nickel content is less than 10% by weight and it can be down to about 4% by weight of Ni or even 1.5% by weight of Ni, by the replacement of nickel with manganese and/or nitrogen. Also ferritic stainless steels with chromium contents above 22% by weight can come in question.

The outer layer of the passive-film-forming alloy (here called PFA) can be applied on the copper canister according to at least two methods:

1) A copper sleeve that contains an insert with spent fuel is sealed and forms a copper canister, after which the sealed copper canister including fuel is introduced into a PFA tube that includes a welded bottom (as an alternative, the bottom is welded onto the tube after introduction of the copper canister in the same). Preferably, the copper canister is introduced with a gap that is as small as possible in order to avoid overly reduction of thermal conductivity. A PFA cover is applied in order to be joined with the PFA tube by robotic welding, thereby to seal the outer casing. The tube can have a longitudinal weld or be seamlessly manufactured. For stainless steels and nickel alloys e.g., it is advantageous for cost reasons to produce with a longitudinal weld, while seamless production by extrusion or press piercing is more expensive.
2) Two PFA sheet halves or alternatively one PFA sheet are/is shaped and pressed tightly around an empty copper casing, after which longitudinal welding takes place (optionally with a thin weld root plate in order to prevent the copper from contaminating the PFA seam). This method will result in a small or even non-existing gap, a shrink fit is e.g. possible to achieve as shrinking takes place in the welded seam. The insert with the spent fuel is thereafter introduced into the copper sleeve that is sealed by welding a copper lid thereupon. It is preferred in order to enable welding of the copper lid by e.g. friction stir welding, that the upper rim of the copper sleeve is arranged some distance above the upper rim of the outer, surrounding, PFA sheet. Accordingly, the PFA lid will have the shape of a sleeve (FIG. 3) that is slipped over and welded together with the surrounding PFA sheet.

If there is also a gap, somewhat impaired heat conduction may result. This can mean that the copper casing reaches a maximum temperature that exceeds 100° C., which will impair its strength and somewhat increase its creeping. This is however not a problem as the outer casing of the passive-film-forming metal or metal alloy, irrespective of which passive-film-former that is used, will have a much better strength (including creeping strength) even if its thickness is only half or even a third of the thickness of the copper layer. The gap between the copper casing and the passive film casing can be eliminated if it is filled with a low melting and corrosion slow metal, such as a tin or lead alloy.

Different types of robotic welding can be used to weld the outer PFA casing, depending on which alloy that is chosen. TIG welding as well as plasma welding are e.g. suitable welding methods. For stainless steel and Ni based alloys, MAG or MIG welding is also suitable.

The material thickness of the outer casing can be varied depending on which passive-film-forming metal or metal alloy that is used, since different metals or alloys have different corrosion resistance. If the casing is made of titanium or a titanium alloy, it is preferred that the casing has a material thickness in the range of 4-30 mm, more preferred in the range of 6-20 mm. For zirconium or zirconium based alloys, it is preferred to have a material thickness in the range of 3-20 mm. Titanium, zirconium and alloys thereof have the best corrosion properties, which means that they can be made thinner. For cobalt based alloys and nickel based alloys, it is preferred to have a material thickness in the range of 8-40 mm, more preferred in the range of 10-30 mm. For stainless steel it is preferred to have a material thickness in the range of 8-50 mm, more preferred in the range of 10-40 mm.

Given that an additional barrier has been added in the form of the outer casing of the passive-film-forming metal or metal alloy, it could be conceivable to reduce the material thickness of the copper casing from the 50 mm intended for the KBS-3 method to 30 mm, e.g. The copper casing should however at least exceed 25 mm and the corrosion protection will naturally be better the larger the material thickness. An important advantage of having a thinner material thickness is however that it will be easier to achieve good welded seams and accordingly sealing of the copper casing could be easier as well as with a better result. For the same reason, it could come into question in case of a thinner material thickness to make the copper casing from a tube with a longitudinal weld without appreciably impairing the properties of the copper casing. The outer casing will moreover result in a considerably increased structural stability that will considerably relieve a copper casing with an insert, meaning e.g. that the strength requirements for the insert can be lowered.

Given that it is possible that the chemical environment can vary several times during different time epochs (ice age, interglaciers), a third metal layer internal of the copper casing can possibly be motivated in connection with additionally increased safety thinking. In that case, such a layer should also be a passive-film-forming alloy (titanium, titanium alloys, zirconium, zirconium alloys, cobalt alloys, nickel alloys or stainless steel). This can also be achieved by the insert with a tight lid being made of stainless cast steel with at least 18% by weight of chromium, which results in several advantages (see below in connection with a load bearing insert).

The canister according to the present invention is preferably also embedded in bentonite clay when it is to be placed in final repository.

The load bearing insert can for example also be manufactured of cast iron, as is suggested in the KBS-3 method. Safety may however be increased by manufacturing the insert from e.g. cast steel with at least 18% chromium, as an alternative to cast iron. This is because hydrogen pressures that are potentially very high can build up inside the canister if water contacts the cast iron (see the discussion above concerning U.S. Pat. No. 4,562,001), whereby the copper casing could crack. This scenario is furthermore accelerated if the mechanical properties of the copper (static strength and creep ductility e.g.) are degraded by the hydrogen, so called hydrogen embrittlement. Naturally, the insert can be formed from other materials.

Figure 2:
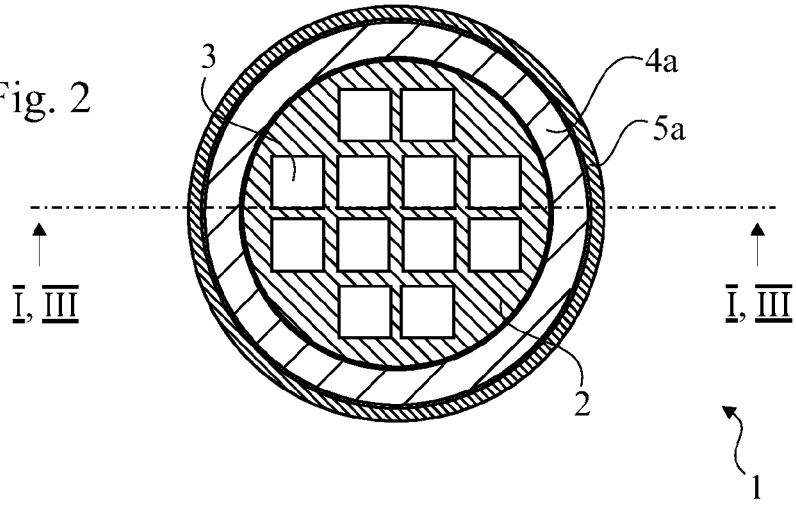
Figure 3:
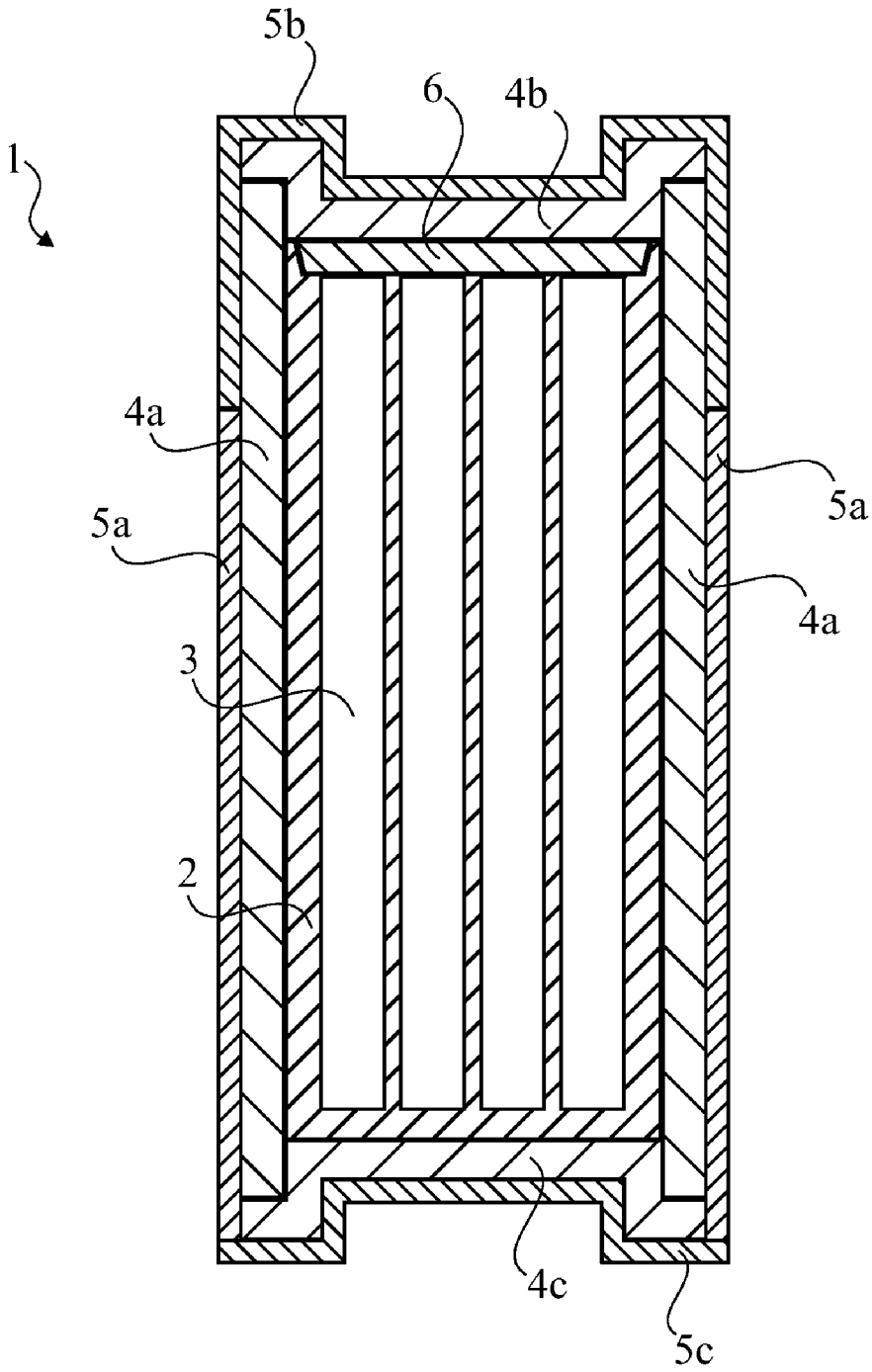

In the following, two embodiment examples of the canister will be described with reference to a number of figures, of which FIG. 1 shows the canister according to a first embodiment, in a longitudinal cross-section, FIG. 2 shows a cross-section of the canister in FIG. 1 and FIG. 3, and FIG. 3 shows a canister according to a second embodiment, in a longitudinal cross-section.

A canister 1 is shown in FIGS. 1 and 2. The canister has an inner copper casing 4*a*, 4*b*, 4*c* comprising a copper tube 4*a* with a copper lid 4*b* and a copper bottom 4*c*. The copper tube 4*a* and the copper bottom 4*c* are joined together by welding (such as friction stir welding or electron beam welding) and form a copper sleeve 4*a*, 4*c*, but the copper sleeve 4*a*, 4*c* can also be made from a single piece by press piercing e.g.

An insert 2 is introduced into the copper casing 4*a*, 4*c*, which insert 2 has a number of longitudinal cavities 3 intended for spent fuel rods. An insert lid 6 seals the insert 2. The copper casing 4*b* has been joined together with the copper casing 4*a*, 4*b* only after the insert has been filled with spent fuel rods. FIG. 2 shows an insert intended for 12 fuel elements with fuel rods, but more as well as fewer can naturally be conceived. For fuel elements of larger cross-section it may e.g. suffice to have one insert 2 that may contain just 4 fuel elements.

An outer casing 5*a*, 5*b*, 5*c* of a passive-film-forming metal or metal alloy encloses the inner copper casing 4*a*, 4*b*, 4*c*. The outer casing 5*a*, 5*b*, 5*c* comprises an outer tube 5*a* that has an outer lid 5*b* and an outer bottom 5*c*, which all three are manufactured from the same passive-film-forming metal or metal alloy (titanium, titanium alloy, zirconium, zirconium alloy, cobalt based alloy, nickel based alloy or stainless steel). In this embodiment, the outer casing 5*a*, 5*b*, 5*c* has been applied over the copper casing 4*a*, 4*b*, 4*c* after the copper lid 4*b* has been joined together with the copper casing 4*a*, 4*c*, i.e. according to method no. 1) above.

FIG. 3 shows an embodiment in which an outer sleeve 5*a*, 5*c* of a passive-film-forming metal or metal alloy, comprising an outer sleeve 5*a*, joined together with an outer bottom 5*c*, has been applied over the copper sleeve 4*a*, 4*c*, before the copper lid 4*b* has been joined together with the copper sleeve 4*a*, 4*c*. Here, it can be seen that the upper edge of the outer sleeve 5*a*, 5*c* is positioned below the upper edge of the copper sleeve 4*a*, 4*c*, thus enabling for the copper lid 4*b* to be welded together with the copper sleeve 4*a*, 4*c*. Thereafter, an outer lid 5*b* can be slipped over the copper lid 4*b* and welded together with the outer sleeve 5*a*, 5*c*. Since the upper edge of the outer sleeve 5*a*, 5*c* is positioned below the upper edge of the copper sleeve 4*a*, 4*c*, the outer lid 5*b* will also be shaped as a sleeve. This corresponds to method no. 2) according to the above and it is the preferred embodiment of the canister according to the present invention.

Naturally, it is realised that the invention is not limited to the above mentioned embodiment examples but can be varied within the scope defined by the claims.

The invention claimed is:

1. A canister for final repository of spent fuel elements from a nuclear reactor comprising:

an insert that contains said spent fuel elements;

an inner copper casing that encloses said insert; and at least one outer casing that encloses said copper casing and that comprises a passive-film-forming metal or metal alloy, the passive film on the casing comprising an essentially oxidic film that is rich in one or more of the metals in the group of metals consisting of the metals zirconium, chromium and titanium.

2. A canister according to claim 1, wherein said essentially oxidic film essentially consists of one or more oxides of one or more of the metals that contain the group of metals consisting of the metals zirconium, chromium and titanium.

3. A canister according to claim 2, wherein said essentially oxidic film principally consists of one or more oxides of one or more of the metals that contain the group of metals that consist of the metals zirconium, chromium and titanium.

4. A canister according to claim 1, where the outer casing consists of cast, forged and/or rolled elements.

5. A canister according to claim 1, wherein the passive-film-forming metal or metal alloy is titanium or a titanium based alloy, which forms a titanium rich oxide, and wherein the outer casing has a material thickness in the range of 4-30 mm.

6. A canister according to claim 1, wherein the passive-film-forming metal or metal alloy is titanium or a titanium based alloy, which forms a titanium rich oxide, and wherein the outer casing has a material thickness in the range of 6-20 mm.

7. A canister according to claim 1, wherein the passive-film-forming metal or metal alloy is zirconium or a zirconium based alloy, which forms a zirconium rich oxide, and wherein the outer casing has a material thickness in the range of 3-20 mm.

8. A canister according to claim 1, wherein the passive-film-forming metal or metal alloy is a cobalt based or nickel based alloy that comprises at least 12% by weight of chromium.

9. A canister according to claim 1, wherein the passive-film-forming metal or metal alloy is a cobalt based or nickel based alloy that comprises at least 14% by weight of chromium.

10. A canister according to claim 8, wherein the outer casing has a material thickness in the range of 8-40 mm.

11. A canister according to claim 8, wherein the outer casing has a material thickness in the range of 10-30 mm.

12. A canister according to claim 1, wherein the passive-film-forming metal or metal alloy is stainless steel comprising at least 18% by weight of chromium, and wherein the outer casing has a material thickness in the range of 8-50 mm.

13. A canister according to claim 1, wherein the passive-film-forming metal or metal alloy is stainless steel comprising at least 18% by weight of chromium, and wherein the outer casing has a material thickness in the range of 10-40 mm.

14. A canister according to claim 12, wherein the stainless steel is an austenitic steel comprising at least 12% by weight of nickel.

15. A canister according to claim 12, wherein the stainless steel is a duplex steel with a nickel content in the range of 1.5-10% by weight of nickel.

16. A canister according to claim 12, wherein the stainless steel is a ferritic steel with a chromium content of at least 22% by weight of chromium.

17. A canister according to claim 12, wherein the passive-film-forming metal is alloyed with tungsten and/or molybdenum such that W+Mo>0.15% by weight.

18. A canister according to claim 1, wherein the inner copper casing has a material thickness of at least 25 mm.

19. A canister according to claim 1, wherein the insert is made of cast iron.

20. A canister according to claim 18, wherein the insert is made of cast iron with a chromium content of more than 13% by weight.

21. A canister according to claim 1, wherein the outer casing constitutes the outermost metal layer.

22. A canister for final repository of spent fuel elements from a nuclear reactor comprising:

an insert constructed and arranged for containing spent fuel elements;

an inner copper casing enclosing said insert; and at least one outer casing enclosing said copper casing, the outer casing being formed from at least one passive-film-forming metal or metal alloy selected from the group consisting of zirconium, chromium and titanium.

* * * * *